United States Patent [19]

Weiser

[11] Patent Number: 4,662,008

[45] Date of Patent: May 5, 1987

[54] REVERSIBLE PLEATED SKIRT

[75] Inventor: Howard Weiser, Willowdale, Canada

[73] Assignee: Highland Queen Sportswear Limited, Toronto, Canada

[21] Appl. No.: 829,365

[22] Filed: Feb. 14, 1986

[30] Foreign Application Priority Data

Feb. 19, 1985 [CA] Canada ..... 474685

[51] Int. Cl.[4] ..... A41D 1/114

[52] U.S. Cl. ..... 2/211; 2/243 B

[58] Field of Search ..... 2/211, 243 B, 105, 74

[56] References Cited

U.S. PATENT DOCUMENTS

| | | | |
|---|---|---|---|
| 2,515,089 | 7/1950 | Kamhi | 2/211 |
| 2,898,601 | 8/1959 | Presson | 2/211 |
| 2,945,238 | 7/1960 | Weiser | 2/211 |
| 3,396,628 | 1/1967 | Collins | 2/211 |

FOREIGN PATENT DOCUMENTS

| | | |
|---|---|---|
| 458893 | 8/1949 | Canada . |
| 626624 | 8/1961 | Canada . |
| 2151456 | 7/1985 | United Kingdom . |

OTHER PUBLICATIONS

Sportrite Jr. Ltd.-advertisement for reversible kiltie published Ca 1955.

*Primary Examiner*—Doris L. Troutman

*Attorney, Agent, or Firm*—Kenneth M. Garrett

[57] ABSTRACT

A pleated skirt, especially a reversible pleated kilt, having the pleats extending the length of the skirt, has at least certain ones of the pleats closed by an adhesive material at the upper end portions thereof so as to lay flat over the waist of a wearer, without detracting from the appearance of the skirt when worn with the reverse side outermost.

17 Claims, 4 Drawing Figures

FIG. 1.
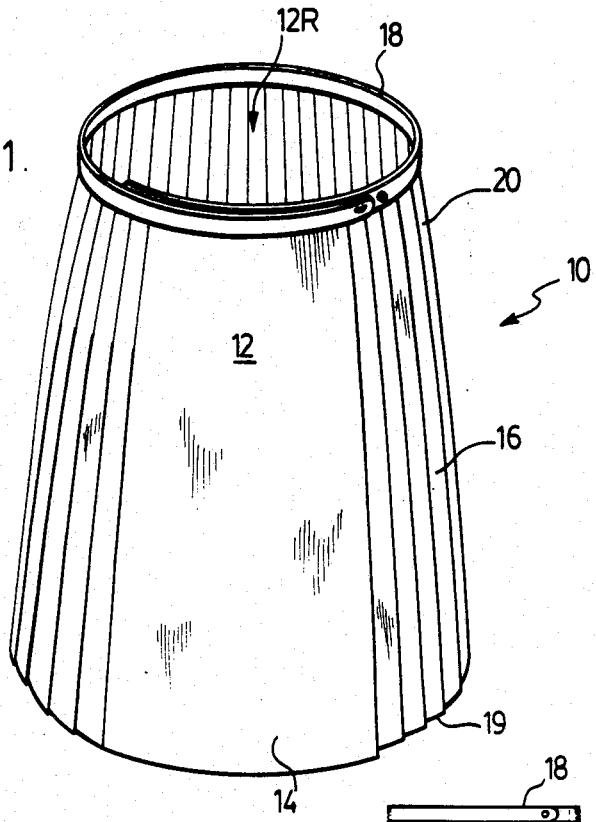
FIG. 2.
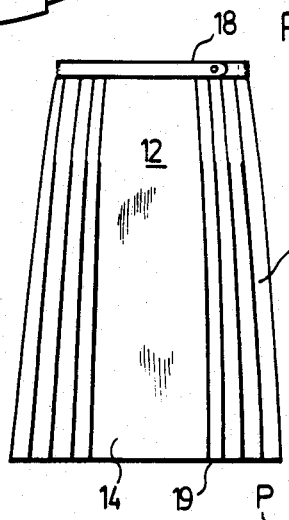
FIG. 3.
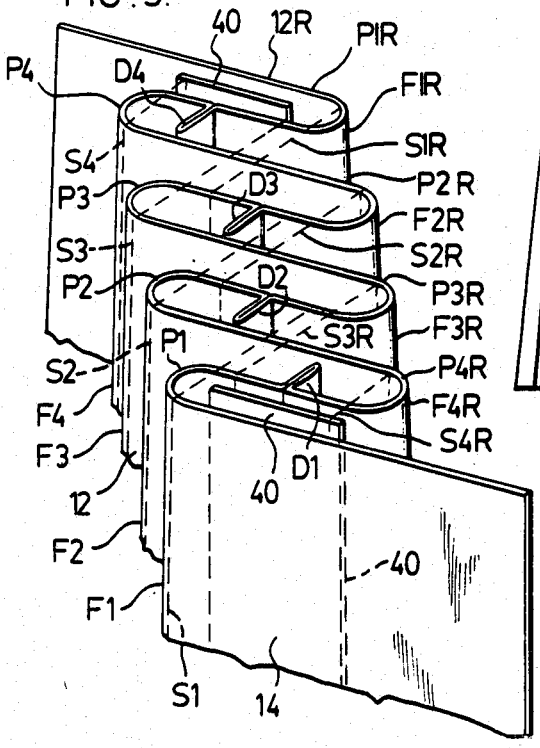
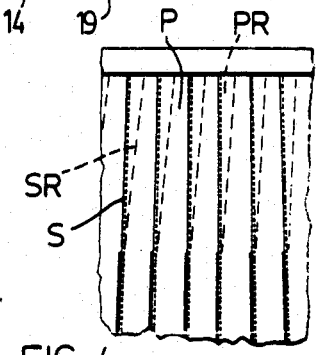
FIG. 4.

REVERSIBLE PLEATED SKIRT

FIELD OF INVENTION

This invention relates to wearing apparel such as skirts. It particularly relates to kilts, especially reversible kilts, which is to say kilts that are constructed whereby they present a pleasing and finished appearance with either major face of the garment facing outwardly.

BACKGROUND OF INVENTION

Reversible pleated skirts have been manufactured and marketed commercially for many years, and an early precursor is described in Canadian Patent 474,685 issued Feb. 19, 1985 for example.

In a pleated garment, material forming a pleat is normally folded beneath the outer face of the garment to form at least three layers. Where the gather of the material is increased to in excess of 3:1, one pleat will overlap an adjacent pleat, to form five layers of material in the overlapping portion.

Where the garment is a skirt, the pleats are normally constrained from opening in the upper portions of the skirt, which is to say those portions which are adapted to fit about the torso of the wearer, and which may be generally referred to as the waist portion of the skirt, by their being sewn shut. Where the skirt is not reversible, the stitch lines sewing the pleats shut are not of concern on the interior face of the garment, as they will not normally be exposed to view when the skirt is being worn.

Where the skirt is reversible, however, this type of sew through stitching would detract from the appearance of the garment. In this instance, the stitching is confined to the overlapping fold areas, i.e. those areas wherein there are five layers of material, with only four of the five layers being stitched together, the fifth layer which forms the opposed face of the garment acting to hide the stitching.

Where the garment is a kilt, the general construction comprises a pleated panel which connects at both lateral sides to an unpleated apron, hereinafter referred to simply as an apron. The pleat adjacent to and overlaying the apron will normally comprise only three layers, taken together with the apron. In this instance it is not possible to sew down the pleat while at the same time hiding the stitching on the opposed face of the kilt, and this last pleat has therefore been left open in previously constructed reversible kilts. This detracts somewhat from the appearance of the kilt. A similar problem arises in respect of each of the pleats where the gather is not in excess of 3:1, as the pleats will not overlap whereby a pleat on a one face can serve to hide the stitching of a pleat on the other face.

SUMMARY OF THE INVENTION

It is then a primary object of this invention to provide pleated skirts, and particularly reversible, pleated kilts of enhanced appearance and construction.

In accordance with one aspect of the invention, a skirt comprises a portion of fabric material folded to form a plurality of pleats extending substantially along the length of the skirt, which is to say from the waistband to the bottom hem. The upper ends of the pleats, which form the waist portion of the skirt, are constrained from opening by means which, in the case of at least one of the pleats, comprises and adhesive substance.

Where the skirt is a kilt, the adhesively closed pleat will include the pleat which is adjacent to and which overlays the apron of the kilt. In the case of a reversible kilt, there will be one such pleat on each major face thereof.

Preferably, the adhesive substance is a fusible resin applied in the form of a self-supporting film.

Desirably, when only one of the pleats is adhesively closed and the other pleats are sewn closed, the edge of the adhesively closed pleat is stitched to give a balanced appearance; such stitching of the edge will, however, only pass through the outer two layers of the fabric, and will not serve to close the pleat.

The invention will now be described with reference to a preferred, illustrative embodiment thereof, in conjunction with the accompanying drawings.

BRIEF DESCRIPTION OF THE DRAWINGS

FIG. 1 shows a pleated kilt in 3 dimensional, perspective view from the top, front;

FIG. 2 shows the kilt of FIG. 1 in front elevation;

FIG. 3 shows somewhat schematically in perspective, fragmented view from above the method of folding and stitching material to form a kilt, with relatively few folds being shown to avoid unnecessary repetition.

FIG. 4 shows in elevation a fragment of the pleated portion of the kilt of FIG. 1, at the upper end of the pleats thereof.

DESCRIPTION OF THE PREFERRED EMBODIMENT

Referring to the drawings in detail, a reversible pleated kilt in accordance with the invention is identified generally therein by the numeral 10. Since each outer element forming the kilt will have an identical element on the reverse face thereof, a numeral used to identify an outer element will also be used to identify the reverse element with the latter R added thereto to differentiate therebetween. Kilt 10 has an outer face 12 and reverse face 12R, and comprises outer and reverse unpleated aprons 14, 14R interconnected by a pleated panel 16. Desirably, the non-pleated and the pleated portions of the kilt are formed from a unitary portion of fabric, but it has been known heretofore to construct pleated reversible kilts wherein the aprons 14, 14R are attached to the pleated panel 16 by sewing.

Pleated panel 16 is formed by forming the fabric of the kilt at fold lines which extend across the length of the fabric, which is to say, from the waistband 18 to the hem 19 of the kilt. Referring specifically to FIG. 3, the fold lines are here identified on the outer face 12, as F1, F2, F3, and F4, and on the reverse face 12R, as F1R, F2R, F3R, and F4R. The sequence of the elements on the reverse face is seen as being reversed when viewed from the outer face, although the sequence of the elements on both faces is identical when viewed from their own respective faces. While in FIG. 3 only 4 pleats are shown on each face 12, 12R, in practise there may well be approximately 40 pleats on each face.

Kilt 10 has a waist portion 20, which comprises approximately the upper one third of the top to bottom length of the kilt, and upon which the pleats are stitched closed, so as to lay flat when the kilt is worn. The lower approximately two thirds of the kilt has the pleats left free to open, although the pleat edges may be stitched for sharpness should this be desired.

In order to provide a form fitting taper to the waist portion 20 of the kilt, darts D1–D4 are sewn into the waist portion. This tapers the pleats upon approach to the waistband 18, and skews the fold lines F1–F4 in a one direction and the fold lines F4R–F1R in an opposed direction, as seen from one side of the garment and which may be best appreciated from FIG. 4. Since the pleats are sewn shut along the fold lines, it will be appreciated that were the stitching to penetrate all layers of material so as to be visible from both sides thereof, divergent stitch lines would be visible on each face of the garment, and this is aesthetically undesirable.

Kilt 10 as illustrated is formed with a gather of in excess of 3:1, whereby alternate folds overlap each other, to form five layers of fabric in the overlapping portions. However, the last pleat of each face, which is to say the pleats overlaying aprons 14, 14R, and which are identified as P4 and P1R, comprise only 3 layers of fabric. In stitching the pleats closed in the waist portion 20, the stitch lines are sewn sequentially, starting with the penultimate pleat on one face of the kilt. Considering the penultimate pleat P3 of outer face 12 of the kilt, this is stitched closed by sewing along line S3, which penetrates through the outer four layers of material, and which consequently is not visible when viewed from reverse face 12R, which stitching may otherwise be referred to as blind stitching. Next, pleat P1R is blind stitched along stitch line S1R, which stitch line is not visible when viewed from face 12 of the kilt. Similar blind stitch lines are formed on each pleat and its reverse counterpart up to and including penultimate pleat P3R of the reverse face. In FIG. 4 the blind stitch lines are identified simply as S and SR.

As thus far described the construction of kilt 10 is known, and kilts of this nature have been marketed commercially for many years. Reverting to the drawings, and in particular FIG. 3, it will be remarked that the last pleat of each face, P4 and P1R, comprise only 3 layers of fabric, including the aprons 12, 12R which they respectively overlay, hence it is not possible to sew down these pleats while at the same time hiding the stitch lines from view on the opposed side of the garment. In order to close these last pleats, there is provided a fusible adhesive layer 40 between the apron and the overlaying fabric layer of the pleat in the waist portion 20 of the kilt. Preferably, and in order to provide a symmetrical and balanced appearance to the kilt, the edge of each of the last pleats, i.e. P4, and P1R, is sewn at S1 and S4R respectively, only the two outer layers being secured together, the stitch line being hidden on the other face of the garment by the underlaying apron 14, 14R respectively. Desirably, adhesive layer 40 is in the form of a self supporting fusible film material such as is well known in the garment manufacturing industry. Expediently, and as illustrated in FIG. 3, adhesive layer 40 is sewn into position by stitch lines S1 and S4R to be interleaved between the pleat and apron, when it will become fused to adhere the pleat and apron together on the final pressing of the kilt.

While the invention has been described in respect to one embodiment thereof, it will be appreciated that many variations therefrom will be possible, and it is intended that all such variations fall within the substance of the claims appended hereto.

I claim:

1. In a skirt comprising a fabric material folded to form a plurality of pleats extending substantially along the length of the skirt, the upper ends of said pleats extending across the waist portion being constrained from opening, the improvement wherein at least one of said pleats is constrained from opening by an adhesive substance.

2. A reversible skirt comprising a fabric material folded to form a plurality of pleats extending substantially along the length of said skirt and means securing said pleats from opening adjacent their upper ends so as to lay flat when said skirt is worn, the means for securing at least some of said pleats from opening comprising an adhesive substance.

3. A reversible skirt as defined in claim 2 wherein said fabric material is folded with a gather of in excess of 3:1 to form overlapping pleats, and wherein others of said pleats are constrained from opening by stitching through four thicknesses of said fabric material where said pleats overlap, the fifth layer of material thereby serving to hide the stitching.

4. A reversible skirt as defined in claim 3, wherein said pleats constrained from opening by an adhesive substance are stitched along the edge of the pleat through two layers only, so as to match the visual appearance of the stitching for constraining others of said pleats from opening.

5. A reversible pleated kilt comprising a portion of fabric having mid portions thereof folded substantially along its length to form a plurality of pleats, said mid portion connecting at each lateral side thereof to an apron portion, at least the pleat overlapping the apron portion on each major face of the kilt being adhered to the apron at upper portions thereof so as to be constrained from opening in said upper portions when said kilt is worn.

6. A reversible pleated kilt as defined in claim 5, wherein said fabric is folded with a gather of greater than 3:1 whereby said pleats are overlapping, and wherein those pleats not overlapping the apron portion are constrained from opening by blind stitching.

7. A reversible pleated kilt as defined in claim 6 wherein each said adhered pleat is stitched along the edge of said upper portions, but not through said apron, so as to match the the visual appearance of said pleats that are blind stitched.

8. A kilt as defined in claim 7 wherein said adhesive is a fusible thermoplastic resin.

9. A kilt as defined in claim 8 wherein said resin is applied to said kilt in the form of a self supporting plastic film.

10. A kilt as defined in claim 9 wherein said fabric material is unitarily formed.

11. A method of making a skirt comprising folding a portion of fabric material to provide a plurality of pleats extending substantially the length of the fabric material, tapering said pleats in about the upper one third thereof on approach to the upper edge of said fabric material, and applying an adhesive material to close at least one of said tapered pleats.

12. A method as defined in claim 11 which includes blind stitching to close others of said tapered pleats.

13. A method as defined in claim 11 wherein said adhesive material is a fusible material, including the step of pressing the skirt to fuse the material.

14. A method as defined in claim 11 wherein said adhesive material is in the form of a fusible film, and including the step of sewing said film to the pleat.

15. A method of making a skirt as defined in claim 11 wherein said material is folded in a manner to provide an unpleated panel on each lateral side of said plurality of pleats, and wherein said adhesive is applied to close the pleat adjacent to each said pleated panel.

16. A method of making a reversible kilt comprising providing a single and unitary portion of fabric material, folding said material to provide a series of overlapping pleats extending between upper and lower edges of said fabric material and an unpleated panel on each lateral side of said pleats; tapering at least a plurality of said pleats in about the upper one third thereof on approach to said upper edge, and applying an adhesive substance to close upper portions of each pleat adjacent to and overlaying said panel on each face of the material.

17. A method as defined in claim 16 including the step of closing the pleats intermediate said pleats overlaying said panels by blind stitching.

* * * * *